United States Patent [19]

Kralik

[11] Patent Number: 4,649,242

[45] Date of Patent: Mar. 10, 1987

[54] STATIONARY CONTACT ASSEMBLY FOR A CURRENT LIMITING CIRCUIT BREAKER

[75] Inventor: Andrew J. Kralik, Marysville, Ohio

[73] Assignee: Siemens Energy & Automation, Inc., Atlanta, Ga.

[21] Appl. No.: 779,682

[22] Filed: Sep. 24, 1985

[51] Int. Cl.[4] ..... H01H 33/20

[52] U.S. Cl. ..... 200/147 R; 200/144 R

[58] Field of Search ..... 200/144 R, 147 R

[56] References Cited

U.S. PATENT DOCUMENTS

| | | | |
|---|---|---|---|
| 3,500,266 | 3/1970 | Torre | 335/16 |
| 3,621,169 | 11/1971 | Heft et al. | 200/144 R |
| 3,631,369 | 12/1971 | Menocal | 200/144 R |
| 3,646,488 | 2/1972 | Iida et al. | 335/16 |
| 3,997,746 | 12/1976 | Harper et al. | 200/144 R |
| 4,149,129 | 4/1979 | Andersen et al. | 335/21 |
| 4,158,827 | 6/1979 | Bratkowski et al. | 335/16 |
| 4,302,643 | 11/1981 | Cox et al. | 200/144 R |
| 4,401,863 | 8/1983 | Lemmer et al. | 200/16 A |
| 4,477,704 | 10/1984 | Mori et al. | 200/147 R |
| 4,490,593 | 12/1984 | Cook | 200/144 R |
| 4,511,772 | 4/1985 | Link et al. | 200/144 R |
| 4,560,847 | 12/1985 | Mori | 200/147 R |

FOREIGN PATENT DOCUMENTS

| | | | |
|---|---|---|---|
| 546145 | 4/1956 | Belgium | 200/144 R |
| 1020080 | 11/1957 | Fed. Rep. of Germany | 200/144 R |
| 1147648 | 4/1963 | Fed. Rep. of Germany | 200/144 R |

*Primary Examiner*—Robert S. Macon

*Attorney, Agent, or Firm*—F. W. Powers; J. L. James

[57] ABSTRACT

A stationary contact assembly is provided for a circuit breaker which has a base, a line terminal and an arc chute. The stationary contact arm is J-shaped and formed from a single piece of conductive material which has a contact affixed to the short leg of the J and is connected to the line terminal. The short leg of the J has a length sufficient for creating electromagnetic blow open forces in response to current flow of a preselected magnitude. An arc runner is positioned between the legs of the J for drawing out an arc into the arc chute and intensifying the electromagnetic repulsion forces.

13 Claims, 2 Drawing Figures

STATIONARY CONTACT ASSEMBLY FOR A CURRENT LIMITING CIRCUIT BREAKER

CROSS-REFERENCE TO RELATED APPLICATIONS

This application is related to application Ser. No. 779,587, filed Sept. 24, 1985, now U.S. Pat. No. 4,608,545, "Movable Contact Arm Assembly For A Current Limiting Circuit Breaker" filed by the present inventor and assigned to the Assignee of this application.

BACKGROUND OF THE INVENTION

This invention relates to a current limiting circuit breaker and more particularly to a stationary contact arrangement for a current limiting circuit breaker.

Since their introduction, current limiting circuit breakers have enjoyed enormous acceptance and success and have become common equipment. Current limiting circuit breakers are still evolving to become better, to have higher current ratings and capacities to be manufactured in a more simple and cost effective manner. The user and manufacturer are concerned about the total cost of circuit breakers and equally concerned about the reliability of the circuit breaker and to a lesser extent the amount of space required for the circuit breaker. Accordingly, it will be appreciated that it would be highly desirable to provide a high reliability current limiting circuit breaker which occupies a minimal amount of space and is simple to manufacture.

During the past several years, circuit breakers have undergone a size reduction whereby the overall dimensions of a circuit breaker have decreased for a given rating or for a given size circuit breaker the rating has increased thereby giving greater total capacity in the same amount of space. Even with all of the tremendous size reductions that have occurred, there is always a desire to reduce the size even further or to manufacture the circuit breaker using less expensive parts and materials in place of exotic or expensive materials. Also, in current limiting circuit breakers which have blow open contacts, there is a problem with maintaining the overall size of the breaker because the length of the contacts must be sufficient to insure a sufficient blow open force. Therefore, there are conflicting interests in building a circuit breaker, to minimize the overall dimensions while insuring that current paths are sufficiently long to insure effective blow open force generation. Accordingly, it can be appreciated that it would be highly desirable to provide a compact circuit breaker which has contacts of sufficient length to develop full electromagnetic blow open forces.

It can also be understood that with increased capacity in modern circuit breakers, that there is a need to have an efficient arc extinguishing system. Generally, as the capacity of the circuit breaker is increased, the size of the arc chute must also be increased. The size of the arc chute can become a limiting factor which will cause the overall dimensions of the circuit breaker to increase. Therefore, it is desirable to provide an arc chute which does not mandate an increase in the overall dimensions of the circuit breaker.

As with the arc chute, there is a point at which the length of the contact arms becomes a limiting factor in circuit breaker size reduction. Since the arc extinguishing system contains magnetic materials, it would be highly desirable to use the arc extinguishing system in concert with the contact arms to intensify the electromagnetic blow open forces and thereby save space.

As the current rating of the circuit breaker increases, more heat and gases are generated during operation. This heat and gas must be exhausted to the exterior of the circuit breaker housing to maintain the internal temperature within the limits set for the class and size of breaker. It can therefore be appreciated that it would be highly desirable to provide a simple baffle which will allow the safe passage of blow open gases to the exterior of the breaker thereby maintaining the internal temperature of the breaker within the prescribed limits.

Accordingly, an object of the present invention is to develop a circuit breaker which has a compact stationary contact arm.

Another object is to provide a circuit breaker which has a compact stationary contact arm but which provides the required blow open forces when used in conjunction with an arc runner which intensifies the electromagnetic blow open forces.

Another object of the invention is to provide a stationary contact arrangement which has an arc runner for drawing an arc into the arc chute.

Yet another object of the invention is to provide a stationary contact assembly which is simple to manufacture and easy to assemble.

SUMMARY OF THE INVENTION

Briefly stated, in accordance with one aspect of the invention, the foregoing objects are achieved by providing a stationary contact assembly for a circuit breaker of the type having a base, a line terminal, and an arc chute. A single piece of conductive material is formed into a J-shaped contact arm having a contact affixed to an exterior surface of the short leg of the J and is connected to the base and the line terminal. An arc runner is positioned between the legs of the J for drawing out an arc into the arc chute and intensifying the electromagnetic repulsion forces.

By forming the stationary contact into a J-shaped contact arm, the length of the contact arm contributing to the blow open forces is increased without increasing the overall dimensions of the circuit breaker. The arc runner inserted between the legs of the J serves to enhance the electromagnetic blow open forces and draws the arc out into the arc chute thereby efficiently extinguishing the arc.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 2:
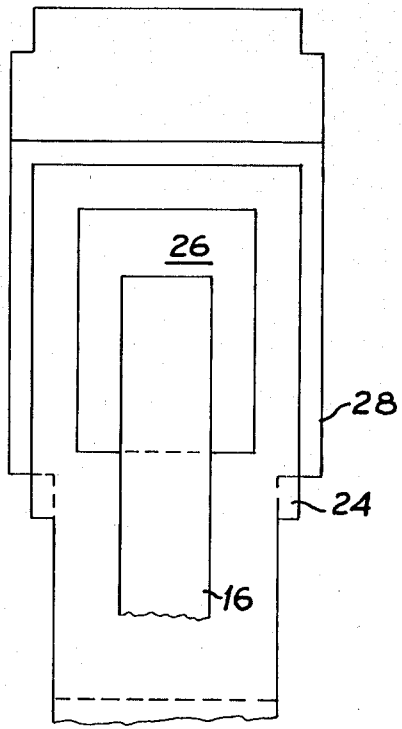
FIG. 2 is a plan view of the arc runner and stationary contact.
Figure 1:
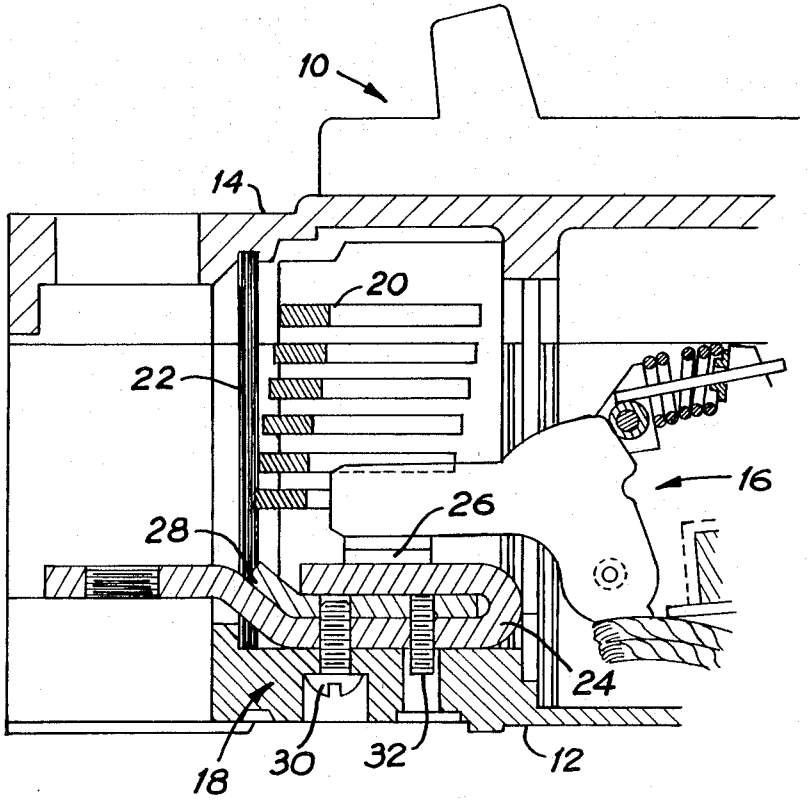
FIG. 1 is a diagrammatical sectional view of a circuit breaker generally taken along the longitudinal axis of one pole of the circuit breaker.

Referring to the drawings, a molded case circuit breaker 10 has a base 12 and a cover 14 which fit together to enclose the operating parts of the circuit breaker. Inside the circuit breaker housing are a movable contact assembly 16 and stationary contact assembly 18 which are constructed to blow open in response to current flow through the contacts of a preselected magnitude. An arc formed when the contacts separate is drawn out into an arc chute 20 where it is extinguished. Gases formed when the contacts separate and the arc is extinguished are expelled through the end barrier 22.

The stationary contact assembly 18 includes a stationary contact arm 24 which is folded or shaped to have a "J" or "U" configuration with a contact 26 affixed on an exterior surface of the short leg of the J. The contact 26 mates with a contact of the movable contact assembly 16. The long leg of the J-shaped stationary contact arm 24 is connected to a line terminal. Preferably, the line terminal and stationary contact arm are formed from a single piece of conductive material such as copper.

The long leg of the J has an opening and the legs of the J are separated by a preselected distance sufficient for receiving an arc runner 28. The arc runner is preferably constructed of steel and is formed into a planar portion and upstanding portion which directs the arc into the arc chute. The planar portion of the arc runner preferably has a threaded opening which receives a screw 30. The screw is inserted through an opening in the base and extends through the opening in the long leg of the J and into the threaded opening of the arc runner. The screw secures the stationary contact arm and the arc runner to the base. The screw is accessible from the exterior of the base which facilitates assembly of the circuit breaker. Having the screw on the exterior of the base also facilitates the changing of a contact assembly should this be desirable. The threaded opening could be located in the long leg of the J instead of the arc runner with equal success. The screw would then preferably protrude through the opening of the arc runner preventing removal of the arc runner from the legs of the J while securing the J and arc runner to the base.

Preferably, the base and long leg of the J have second openings and the arc runner has a second threaded opening which extends the entire thickness of the arc runner. Alternatively, the long leg of the J can be threaded. When the long leg of the J is threaded, the arc runner does not require the second opening. By this construction, an adjusting screw 32 can be used to adjust the separation between the legs of the J and more importantly to adjust the angle with which the contact of the stationary contact arm meets the contact of the movable contact arm. Thus, the adjusting screw is useful not only in the initial manufacture of the circuit breaker, but also in the field after the contacts have undergone some wear to insure that the contacts properly close.

Referring to FIG. 2, the arc runner 28 is wider than the stationary contact 24 and extends beyond the edges of the stationary contact. The arc chute 20 sits atop the arc runner which positions the arc chute in a desired position for drawing out and extinguishing the arc. The upstanding end of the arc runner extends behind the plates of the arc chute. The plates of the arc chute may be positioned generally parallel to the planar portion of the arc runner. The lowermost plates of the arc chute can be positioned closer to the line terminal and further from the contacts so that as the movable contact arm moves in an arcuate path, the plates of the arc chute remain equidistant from the path of travel of the movable contact. In this manner the arc is drawn out smoothly and efficiently.

The arc runner 28 which is preferably constructed of magnetic steel acts as a force magnifier which concentrates the electromagnetic blow open forces. The arc runner and stationary contact work in concert so that the length of the stationary contact does not become a limiting factor in the effort to reduce the circuit breaker size. When used in combination with the arc runner, the length of the stationary contact arm can be shorter than that required when used alone because the arc runner concentrates the force which makes the effect length of the arm quite sufficient.

An end barrier 22 is positioned in slots formed in the base 12 of the circuit breaker. The end barrier is positioned behind the arc chute adjacent line terminal and long leg of the J-shaped contact arm. The end barrier is perforated so that the gases generated during the arc extinguishing process can be expelled from the interior of the breaker to the atmosphere. The end barrier is preferably constructed of a non-metallic material which helps insulate personnel from the conductive portions on the interior of the circuit breaker.

While the operation of the preferred embodiment of the present invention is believed clearly apparent from the foregoing description, further amplification will subsequently be made in the following brief summary of such operation. The circuit breaker is shown with the contacts in the closed position. While in this position during assembly, notice is taken of the manner in which the contact surfaces mate. Since improper mating exposes less contact area which will cause the circuit breaker to operate at a higher temperature, the adjusting screw 32 is used to alter the spacing between the legs of the J thereby changing the angle of the stationary contact and altering the amount of contact surface area which mates with the contact surface area of the stationary contact. If proper contact cannot be made, the screw 30 may be removed and the stationary contact assembly can be replaced so that proper alignment can be obtained.

Under load as current flows, it enters through the line terminal, flows through the long leg of the J, through the short leg of the J, through the stationary contact positioned on the exterior surface of the short leg of the J and to the contact of the movable contact arm and finally to the movable contact arm. It is seen that this current flow path sets up repulsive electromagnetic fields which tend to urge the moveable contact arm and stationary arm to separate. The repulsive force is concentrated or intensified by the arc runner. Under normal load, the contacts do not separate but, upon the occurrence of a specified amount of current flow, as in the case of a fault, the electromagnetic repulsive forces are great enough to blow the contacts apart thereby breaking the circuit.

As the contacts begin to separate, an arc is drawn and that arc is urged into the arc chute. As the contacts continue to open, the arc is drawn further up into the arc chute where it is finally extinguished. It is to be noted that this separation occurs very rapidly in the matter of a mere fraction of a second. The arc is accompanied by heat which must be dissipated from the interior of the circuit breaker.

Heat is expelled from the circuit breaker housing through the perforated end barrier. For each size and class of circuit breaker, the number and size of perforations can be easily determined.

It will now be understood that there has been disclosed a stationary contact assembly for a circuit breaker which is easy to assemble. The stationary contact arm has an adjusting screw so that the position of the contact can be adjusted either during manufacture or later in the field as required. The arc chute efficiently and effectively draws out and extinguishes the arc and the line barrier readily expels the exhaust gases to the atmosphere. By folding the terminal into the J configuration, the contact can be positioned on a contact arm which has a length sufficient for creating electromagnetic blow open forces either alone or in combination with the arc runner, in response to current flow of a preselected magnitude. This novel stationary contact assembly can interrupt a higher current because the increased effective length of the electromagnetic repulsion path insures that the interruption will be done quickly. Yet with the increased interrupting capacity, the space requirements are not increased because the arc runner concentrates the blow open forces allowing the J-shaped contact arm to be shortened.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A stationary contact assembly for a circuit breaker of the type having a base, a line terminal and an arc chute, comprising:

a single piece of conductive material formed into a J-shaped contact arm having a contact affixed to an exterior surface of the short leg of the J and being connected to the base and line terminal, said short leg having a length sufficient for creating electromagnetic repulsion forces in response to current flow of a preselected magnitude; and an arc runner having a planar portion and being positioned between the legs of the J for drawing out an arc into the arc chute and intensifying the electromagnetic repulsion forces said arc chute having plates positioned parallel to the planar portion of the arc runner.

2. A stationary contact assembly according to claim 1, including a perforated, non-metallic end barrier positioned in the base.

3. A stationary contact assembly according to claim 1, including an end barrier behind the arc chute adjacent the line terminal and long leg of the J-shaped contact arm.

4. A stationary contact assembly according to claim 3, wherein the end barrier is non-metallic.

5. A stationary contact assembly according to claim 1, wherein the base has a slot and an end barrier is positioned in the slot.

6. A stationary contact assembly according to claim 1, wherein one of the arc runner and long leg of the J has a threaded opening and the other of the arc runner and long leg of the J has an opening and the base has an opening and wherein a screw threadably engages the threaded opening after passing through the base opening securing the arc runner and contact to the base.

7. A stationary contact assembly according to claim 6, wherein the screw is accessible from the exterior of the circuit breaker.

8. A stationary contact assembly according to claim 1, wherein the arc runner extends beyond the edges of the contact arm and the arc chute sits atop the arc runner.

9. A stationary contact assembly according to claim 1, wherein the arc runner has a threaded opening therethrough, the long leg of the J has an opening and the base has an opening and including an adjusting screw mateable with the threaded opening and accessible through the openings of the base and long leg of the J for altering the separation of the legs of the J.

10. A stationary contact assembly for a circuit breaker of the type having a line terminal and a base with a slot and an opening therein, comprising:

a J-shaped contact arm having a short leg with a exterior surface with a contact thereon and having a long leg with an opening therein and connected to the line terminal;

an arc chute having a plurality of plates;

an arc runner having a planar portion and a threaded opening and being positioned between the legs of the J; and a screw threadably engaging the arc runner after passing through the base opening and opening of the long leg of the J thereby securing the arc runner and contact to the base.

11. A stationary contact assembly according to claim 10, including a perforated, non-metallic end barrier positioned in the base slot behind the arc chute adjacent the line terminal.

12. A stationary contact assembly according to claim 10, wherein the arc runner extends beyond the edges of the contact arm and the arc chute sits atop the arc runner.

13. A stationary contact assembly according to claim 10, wherein the arc chute plates are oriented parallel to the planar portion of the arc runner.

* * * * *